United States Patent [19]

Harangozo

[11] 4,221,442

[45] Sep. 9, 1980

[54] MODULAR WALL CABINET AND ASHTRAY RECEPTACLE

[75] Inventor: Julius Harangozo, Scarborough, Canada

[73] Assignee: Unique Ingenious Specialties Manufacturing and Sales Inc., Agincourt, Canada

[21] Appl. No.: 37,207

[22] Filed: May 8, 1979

[51] Int. Cl.[2] ..... B65D 25/24; E05B 65/52

[52] U.S. Cl. ..... 312/294; 312/242; 312/291; 70/175

[58] Field of Search ..... 312/184, 242, 246, 138 R, 312/139, 100, 291–295; 70/77–79, 175; 220/18, 3.5

[56] References Cited

U.S. PATENT DOCUMENTS

| | | | |
|---|---|---|---|
| 3,276,834 | 10/1966 | Greenwald et al. | 312/242 |
| 3,287,079 | 11/1966 | Courson | 312/291 |
| 3,620,404 | 11/1971 | Grasso | 312/242 |
| 3,722,236 | 3/1973 | Zelenko | 70/78 |

*Primary Examiner*—Casmir A. Nunberg
*Attorney, Agent, or Firm*—Arne I. Fors; Robert F. Delbridge

[57] ABSTRACT

A modular cabinet containing a tilt ashtray and various embodiments of a lock mechanism are disclosed.

The modular cabinet and tilt ashtray comprises an exterior frame suitable for flush mounting on or projection from a wall surface, a rectangular metal cabinet rigidly mounted within said exterior frame having a pair of opposed recesses of equal width formed transversely in each of the cabinet sidewalls for receiving an ashtray having a length substantially equal to the distance between the opposed recesses for slidable insertion into the cabinet, and a door pivotally mounted on the exterior frame adapted to close the lower portion of the cabinet including the portion containing the ashtray such that the ashtray cannot be withdrawn from the cabinet when the door is closed.

A lock mechanism is secured to the exterior frame flange and adapted to engage a flange or catch formed on the door. One embodiment of lock in combination with the cabinet comprises a pair of apertures formed in a door flange and the lock housing adapted to be aligned when the door is closed such that a pin can be inserted through the apertures to engage the lock bolt for depression or retraction of the lock bolt and release of the door.

Another embodiment of lock comprises a cable attached to the lock bolt extending from the rear of the lock bolt and accessible to an operator who can retract the bolt by pulling or shortening the cable to release the lock mechanism. A particular embodiment of this mechanism includes a rotatably mounted actuator which can release a pair of locks simultaneously by rotation of the actuator which respectively shortens the cable.

16 Claims, 14 Drawing Figures

FIG.1.
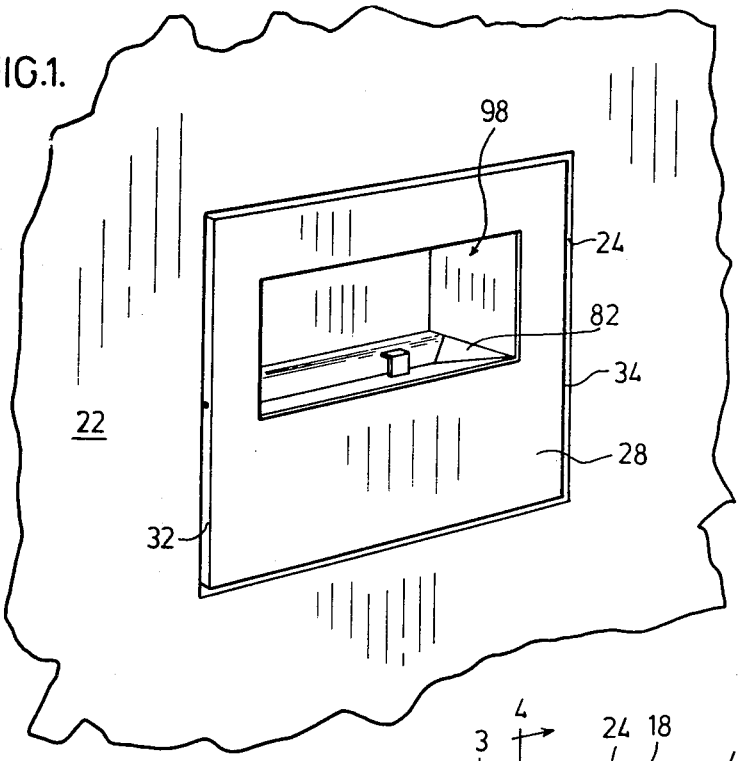
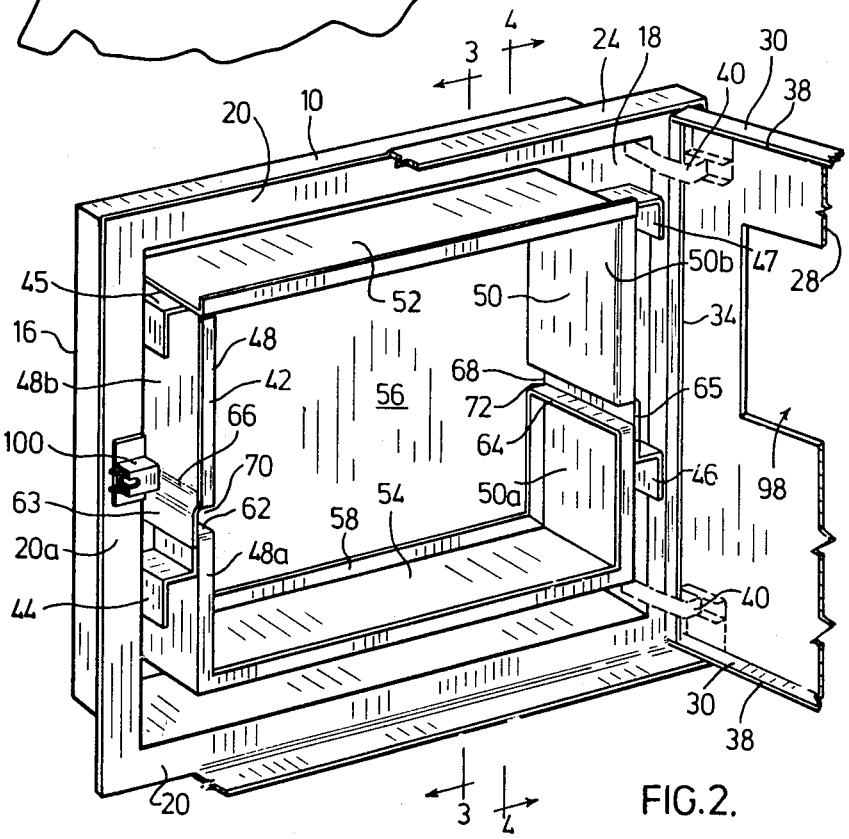
FIG.2.

MODULAR WALL CABINET AND ASHTRAY RECEPTACLE

This invention relates to a wall cabinet and is particularly directed to a novel modular wall cabinet having a novel lock for housing a removable tilt ashtray.

Known wall-mounted ashtray receptacles having a tip action are prone to theft and vandalism. It is a principal object of the present invention to provide a modular wall cabinet for housing a substantially theft-free and vandal-proof ash receptacle.

It is another object of the present invention to provide an aesthetic modular wall cabinet having a novel door lock which permits easy access to and removal of the ash receptacle and which, in one embodiment, maintains the structure substantially theft-free and vandal-proof.

The modular cabinet of the invention comprises the combination of: an exterior frame comprised of spaced sidewalls and top and bottom walls joined to form an integral rectangular structure, said frame walls having an outwardly extending peripheral flange for mounting the cabinet in a wall opening, a rectangular metal cabinet having a pair of opposed sidewalls and opposed top and bottom walls, said sidewalls having a pair of opposed recesses of equal width formed transversely therein equispaced from the bottom wall, an ashtray having a length substantially equal to the distance between the opposed recesses and having an equal thickness at each end slightly less than the width of the recesses for slidable insertion of the ashtray into said recesses whereby said ashtray is restricted from vertical movement and an ash receptacle space is formed within the cabinet below the ashtray, means for rigidly securing said cabinet to the exterior frame, a door pivotally mounted on said frame to open and close said cabinet, said door adapted to close said pair of opposed sidewall recesses and said ash receptacle space whereby the ashtray is locked in the cabinet when the door is closed, said door having an opening formed therein to permit access to the ashtray, and means mounted on the frame for locking the door in its closed position.

The locking means of the invention comprises an elongated housing of substantially rectangular cross-section with sidewalls, and a front wall and a rear wall, said housing secured to an exterior sidewall flange, an elongated U-shaped bolt having a web and depending sidewalls slidably mounted within said housing with the bolt web adjacent the sidewall flange for linear reciprocal movement therein, said bolt sidewalls having bevelled extensions projecting from the housing adapted to be engaged by the door flange when the door is closed, said bolt having an upstanding intermediate wall extending transversely between the bolt sidewalls, a spring compressed within the housing abutting the inside of the bolt transverse wall and a housing rear wall whereby the bolt extensions normally are biased to project from the housing through the housing front wall, and said door and housing front wall each having an aperture formed therein adapted to be aligned with each other when the door is closed whereby a pin can be inserted through said apertures to engage the bolt transverse sidewall for depression of the bolt and bevelled extensions and release of the door.

Another embodiment of locking means adapted to function as a friction lock comprises an elongated housing having sidewalls with flanged bases and front and rear walls, said housing having slots formed in the front wall adjacent the sidewalls, a U-shaped bolt having a web and bevelled arms depending from said web, said bevelled arms adapted to project through the housing front wall slots, a compression spring mounted within said housing to a but the rear side of the bolt and the inner side of the rear wall whereby the bolt is normally biased against the inner side of the housing front wall with the bevelled arms projecting therefrom but can rock within the housing to releasably engage or release a door catch.

The foregoing objects of the invention and their construction and operation will become apparent from the following detailed description thereof taken in conjunction with the accompanying drawings, in which:

FIG. 1 is a perspective view of the modular wall cabinet of the invention, in its closed position, flush-mounted in a wall;

FIG. 2 is an enlarged perspective view of the modular wall cabinet shown in FIG. 1, with the ashtray and ash receptacle removed, in its open position;

Like reference characters refer to like parts throughout the description of the drawings.

Figure 3:
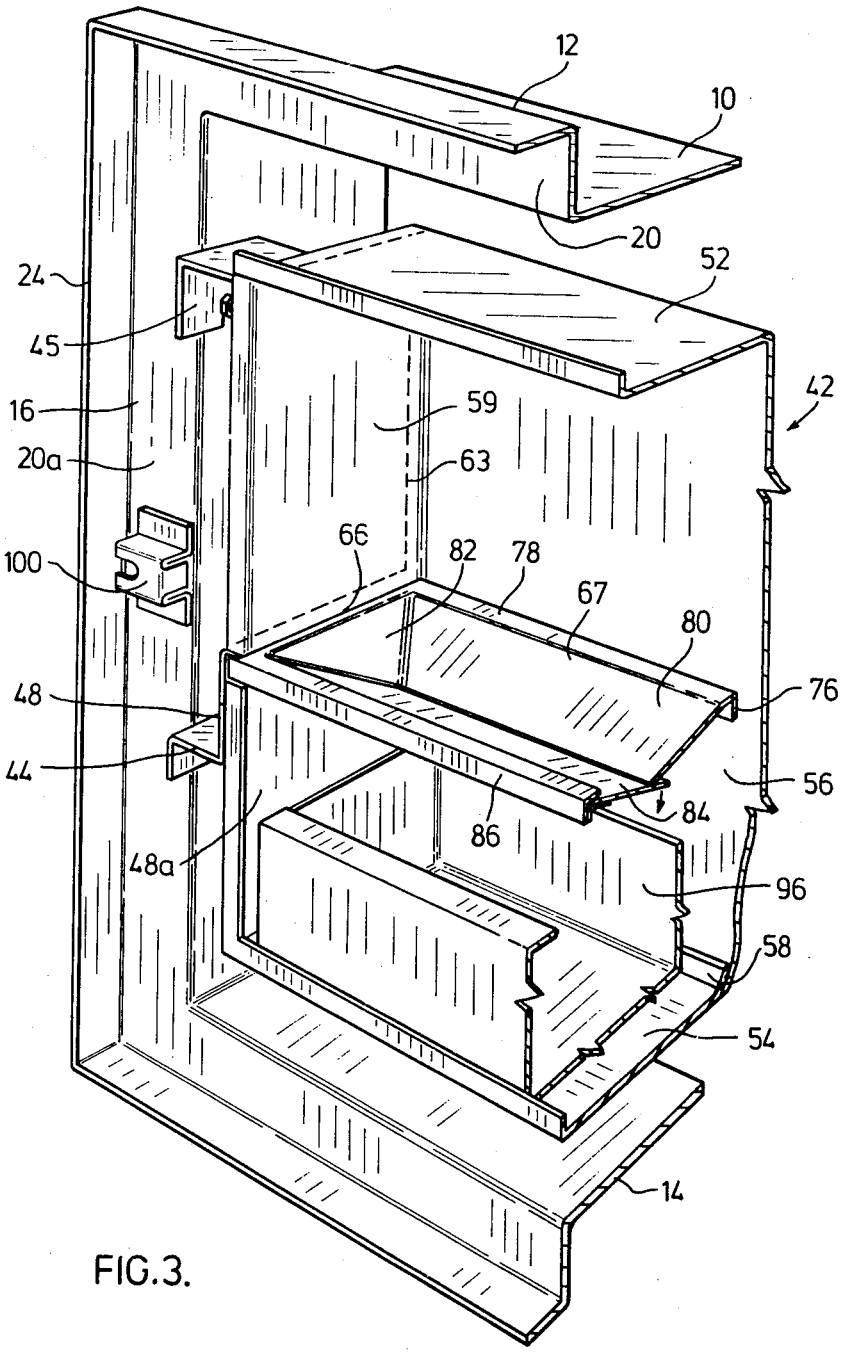
FIG. 3 is a cut-away perspective view, taken along line 3—3 of FIG. 2, of the structure of the invention with the ashtray and ash receptacle in their operative positions.
Figure 4:
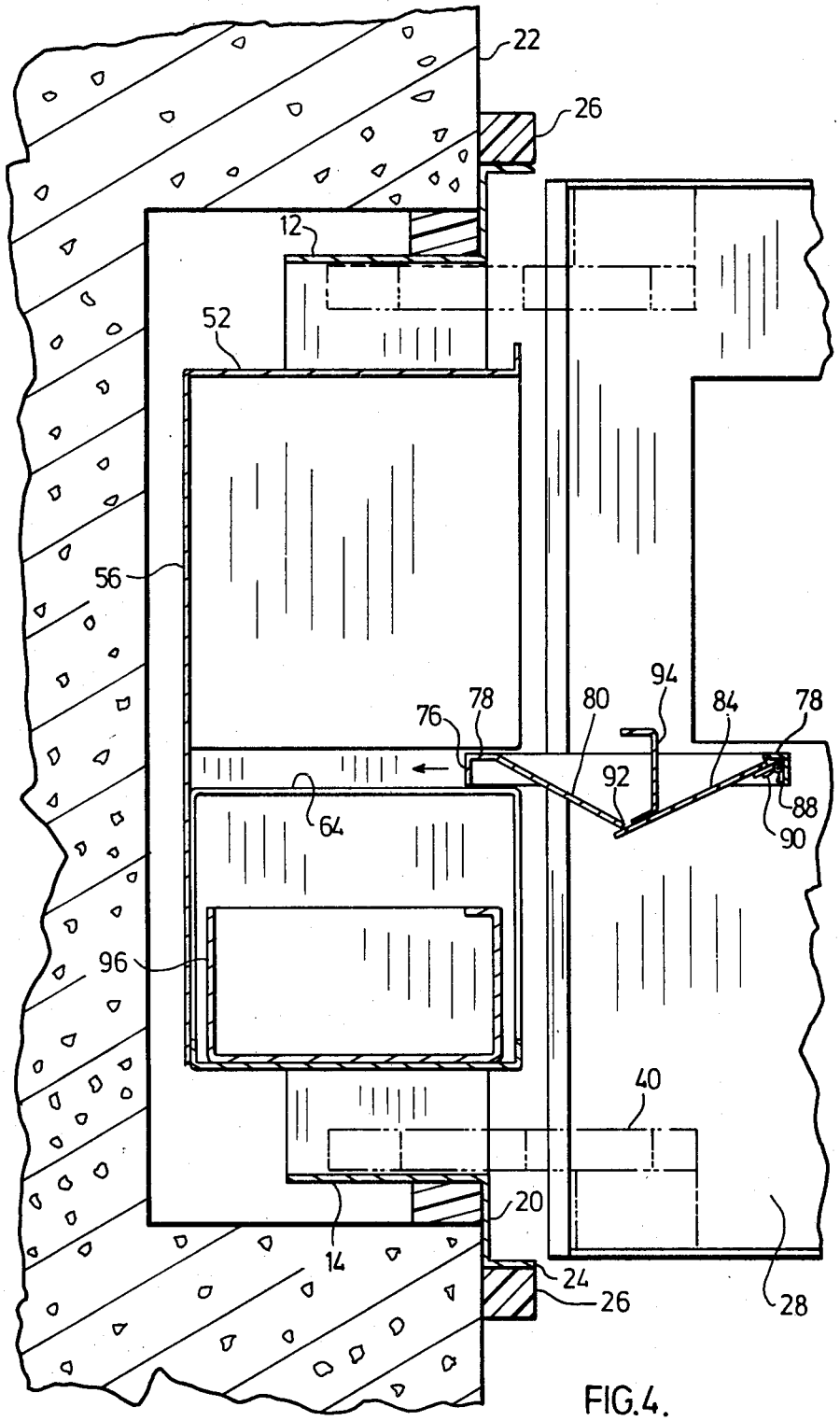
FIG. 4 is a vertical section taken along line 4—4 of FIG. 2 showing the cabinet in a well-mounted position and the ashtray being inserted into the housing.
Figure 5:
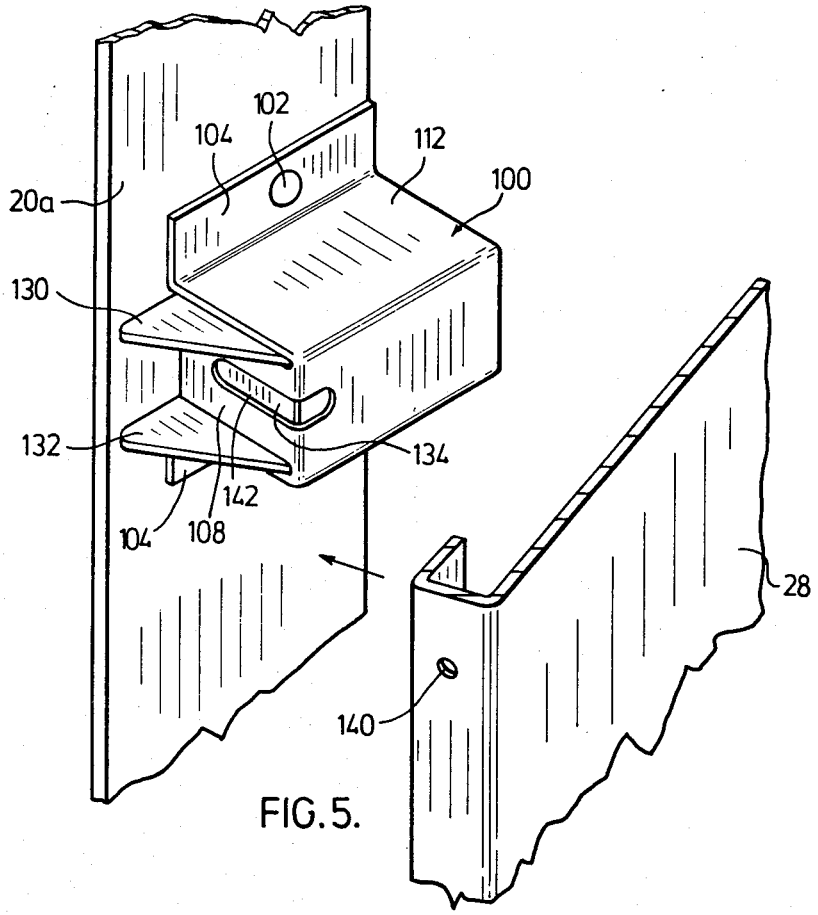
FIG. 5 is a perspective view of an embodiment of the lock of the invention preparatory to closing of the door and engagement of the door flange.

With reference to FIGS. 1–4, the modular wall cabinet of my invention comprises a metal frame 10 having opposed top and bottom walls 12,14 and opposed sidewalls 16,18 each having a front lateral flange 20 adapted to seat on wall 22 for flush mounting of flange 20 upon insertion of frame 10 within a wall opening, FIG. 4. Flange 20 may have an upstanding forward projection 24 adapted to receive peripheral molding 26, if desired, or the edge of projection 24 can be mounted flush with wall 22 with regress around the door, FIG. 1.

Frame 10 is closed by door 28 mounted on frame 10 by means of a pair of vertically spaced hinges 40, indicated in FIG. 2, permitting a full 180° bi-pass swing of the door. Door 28 has peripheral flanges 30 bent rearwardly therefrom on each edge and side edges 32,34 of the door each has a second flange 34,36 bent inwardly therefrom coplanar with the inner edges 38 of upper and lower flanges 30 for reasons which will become apparent as the description proceeds.

Rectangular cabinet 42 is mounted within frame 10 and equally spaced from the side and top and bottom walls by means of lower brackets 44,46 and upper brackets 45,47, FIGS. 2 and 3, welded or bolted thereto. Cabinet 42 comprises sidewalls 48,50, top and bottom walls 52,54 and rear wall 56. With particular reference to FIGS. 3 and 4, top wall 52, and rear wall 56 can be formed integrally from a single sheet of metal. Lower side walls 48*a*, 50*a* and bottom wall 54, which have a rear flange 58 adapted to overlap rear wall 56 for securement thereto by spot welding, preferably are formed from a separate sheet of metal. An inwardly bent flange 62 is formed transversely of wall 47*a* at its upper extremity and a flange 64 is in like manner formed in the upper extremity of wall 50*a* equally spaced from bottom wall 54 to form supports for ashtray 66, FIG. 3. The upper portions 48*b*, 50*b* of sidewalls 48,50 extend forwardly from rear wall 56 planar with the inner edges of flanges 62,64 respectively, and are secured thereto by spot welding of flanges 63, such that the lower edges 66,68 of sidewalls 48*b*,50*b* are spaced from flanges 62,64 to define recesses 70,72 therebetween. The upper and lower portions 48*a*,50*a* and 48*b*,50*b* of walls 48,50 respectively are interconnected by outwardly bent upper wall portions 63,65 welded to the lower walls to stiffen the sidewalls and maintain ashtray 67 centrally located.

Ashtray 67 is rectangular in plan having a downwardly depending flange 76 formed along each edge bent from a marginal ledge 78 extending about the periphery of the said ashtray. The rear half of ashtray 67 has a downwardly inclined wall 80 extending longitudinally of the said ashtray connected to the ends of the ashtray by a downwardly inclined V-shaped portions 82. A longitudinally extending downwardly inclined plate 84 is pivotally mounted beneath the forward edge 86 of the ashtray by means of a hinge 88 welded to flange 76 and to the underside of plate 84, FIG. 4. A coil spring 90 secured to hinge 88 biases plate 84 in an upwardly direction for abutment against the downward edge 92 of wall 80. An upstanding member 94 secured to the upper side of plate 84 permits a user to conveniently depress plate 84 to drop ashes into box 96 seated in the space defined within cabinet 42 below ashtray 67. The ashtray has a length slightly less than the width of the cabinet at recesses 70,72 for slidable movement of ashtray 67, as indicated in FIG. 4, into and out of the said recesses.

The door 28 is normally locked in its closed position as viewed in FIG. 1 with opening 98 providing access to the ashtray. It will be evident that the ashtray cannot be withdrawn or removed from the cabinet once the door is in its closed position but may be readily withdrawn once the door is opened, FIGS. 2 and 3.

FIGS. 5–8 illustrate lock 100 particularly adapted for use with the said wall cabinet. Lock 100 comprises an elongated housing having a rectangular cross-section with lateral outwardly extending flanges 104 adapted to seat on flange 20*a* for securement thereto by means of a pair of rivets 102 passing through flange holes 105. Lock housing 100 has front end wall 108 defining slots 116 adjacent sidewalls 112,114 and rear end wall 110 defining slots 118 adjacent said sidewalls 112,114 to permit the front and rear ends of sidewalls 120,122 of U-shaped bolt 124 to freely slide therethrough. The lower end of rear wall 110 is shortened adjacent its base to permit the bottom wall or web 128 of bolt 124 to extend through slot 130, FIG. 6. Bolt 124 has a pair of bevelled sidewall extensions 130,132 undercut at 133,135, respectively, extending from its front end interconnected by intermediate wall 134 upstanding from web 128. Bolt 124 normally is biased in a forward extending position with said bevelled sidewall portions 130,132 extending from housing 100 by the bias of compression spring 136 which is located within housing 100 and squeezed between rear housing wall 110 and bolt forward intermediate wall 134.

Figure 6:
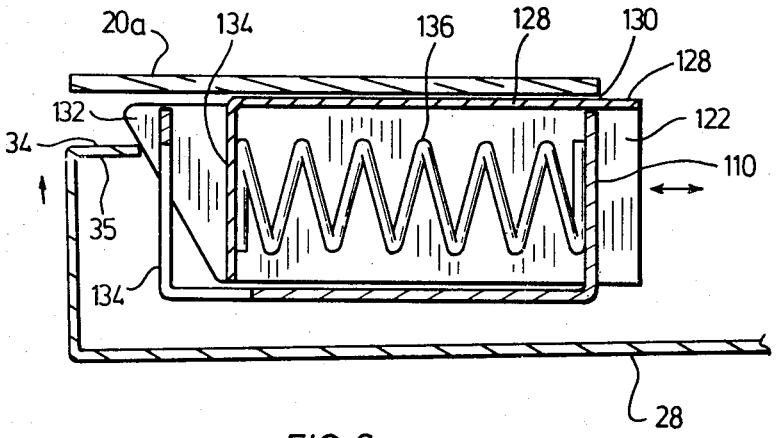
FIG. 6 is a longtiudinal section of the lock mechanism shown in FIG. 5 showing the lock bolt being depressed as the door is closed.
Figure 7:
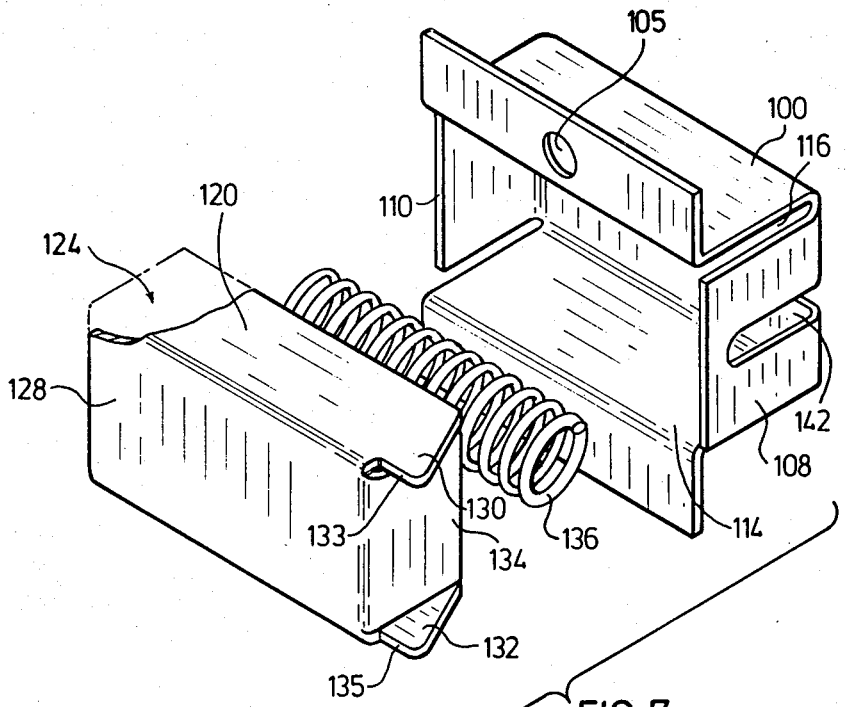
FIG. 7 is an exploded perspective view of the lock shown in FIGS. 5 and 6.
Figure 8:
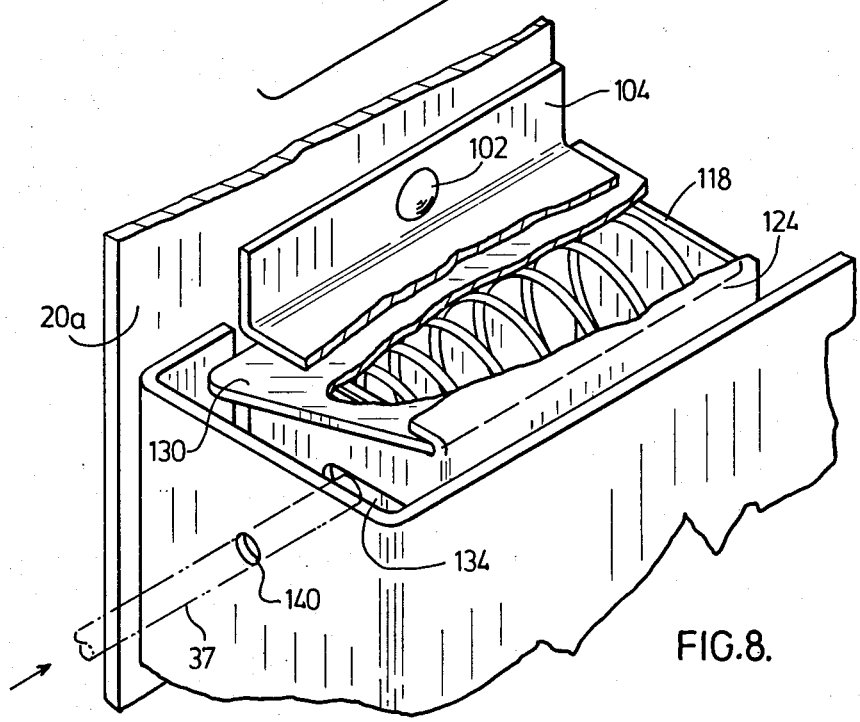
FIG. 8 is a cut-away perspective view of the said lock indicating the manner in which the lock can be released.

With reference to FIGS. 6 and 8, it will be seen that as door 28 is closed bevelled projections 130,132 are depressed into housing 100 by door flange 34 until flange 34 abuts frame flange 20*a* at which time flange 34 becomes co-planar with the undercut portions 133,135 of bolt 124 permitting projections 130,132, which are pressed forward by spring 136, to engage the inner side 35 of flange 34.

Lock 100 can be easily opened by inserting a pin designated by numeral 37, FIG. 8, through opening 140 formed in door flange 32 to abut forward wall 134 of bolt 124 through elongated housing slot 142 for depression of said bolt 124 and release of flange 34.

Figure 10:
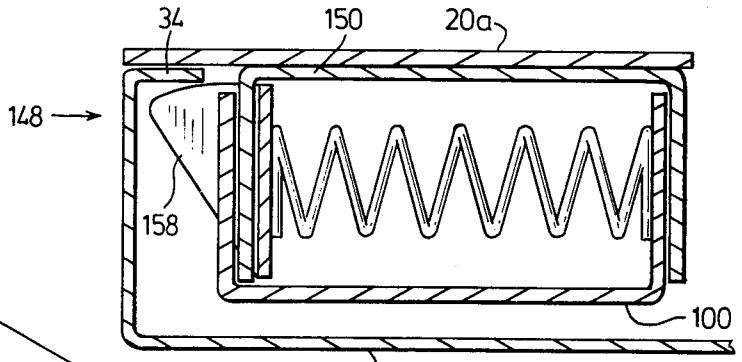
FIG. 10 is a longitudinal section of the lock mechanism illustrated in FIG. 9.
Figure 9:
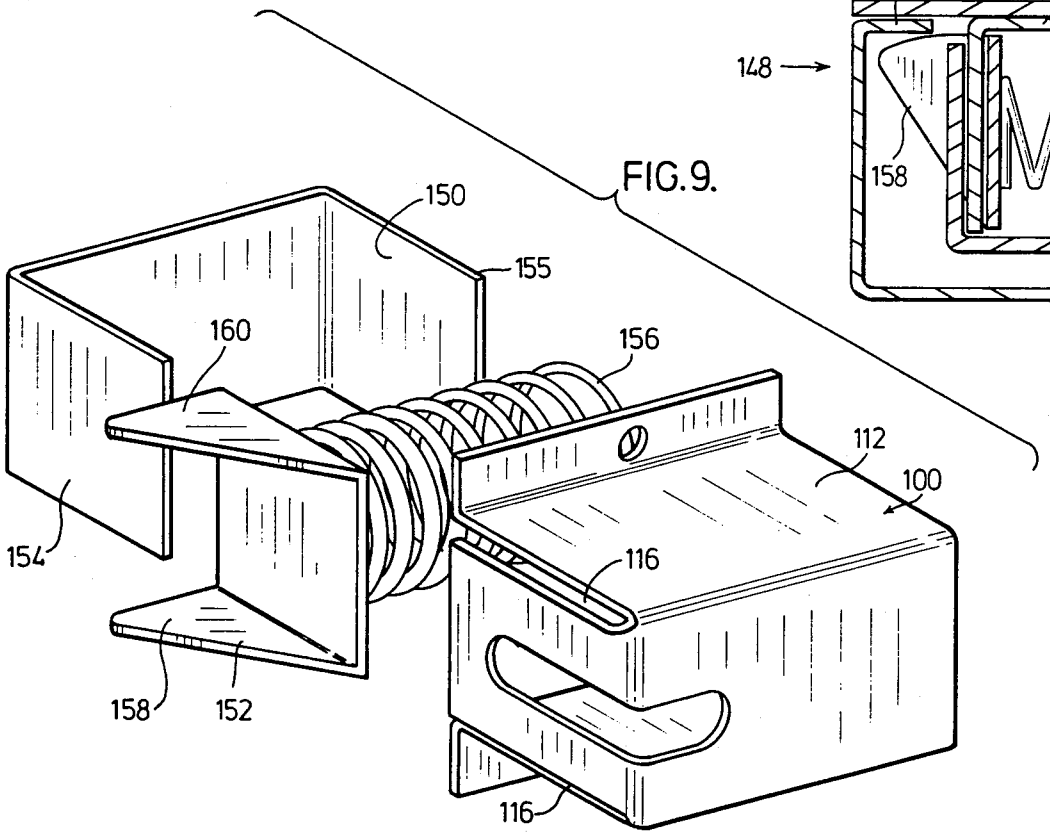
FIG. 9 is an exploded perspective view of another embodiment of the lock of the invention.
Figure 11:
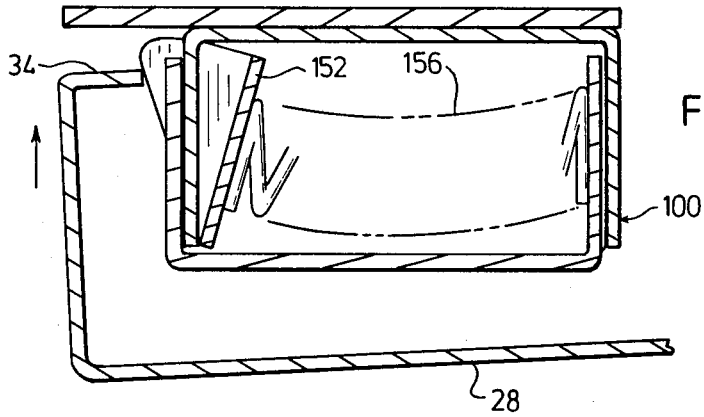
FIGS. 11 and 12 are longitudinal sections corresponding to the view shown in FIG. 10 illustrating the operation of the lock mechanism as the door is closed and opened, respectively.
Figure 12:
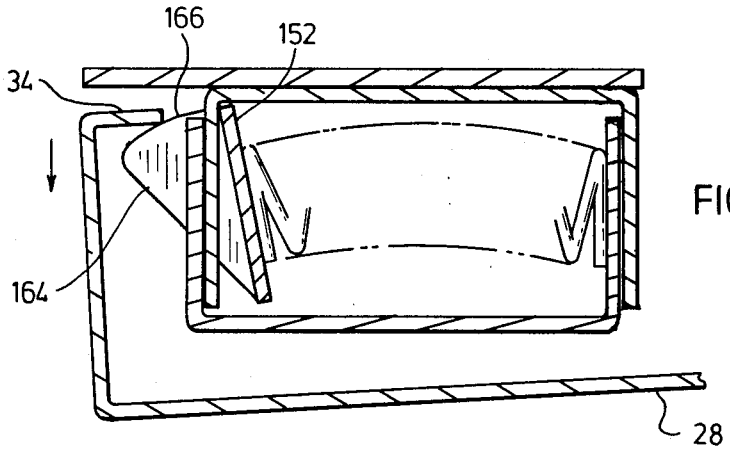

The second embodiment of lock 148 illustrated in FIGS. 9–12 comprises a longitudinally U-shaped member 150 stationed essentially within housing 100 and adapted to receive bolt 152 which normally straddles and abuts wall 154 under the bias of compression spring 156, FIG. 10, which is positioned between walls 154,110. Bolt 152 has a pair of bevelled projections 158,160 normally extending from housing 100 which are adapted to engage flange 34 of door 28. FIG. 11 illustrates the operation of lock 148 upon closure of door 28 wherein door flange 34 rocks bolt 152 within housing 100 under the bias of spring 156 permitting flange 34 to pass over said depressed projections to the position shown in FIG. 10. FIG. 12 illustrates the operation of lock 148 upon the opening of door 28 wherein door flange 34 rocks bolt 152 in the opposite direction. The edges 166 of projections 158,160 are rounded to permit bolt 152 to not only rock but also to be slightly depressed within housing 100 as door flange 34 passes over bolt 152. It will be evident that this embodiment of my invention provides a simple friction lock but would not prevent unauthorized opening of the cabinet door as provided by the embodiment of my invention illustrated in FIGS. 5–8.

Figure 13:
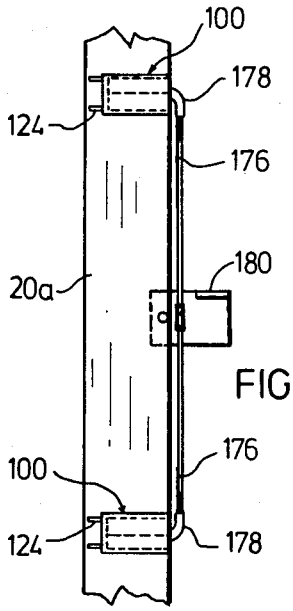
FIG. 13 is an elevation of another embodiment of the lock used in pairs with an interconnecting cable release mechanism.
Figure 14:
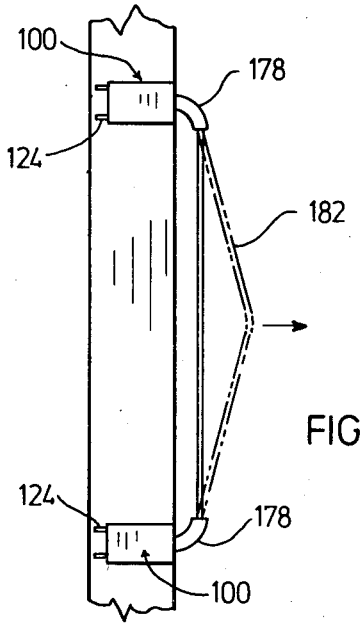
FIG. 14 is an elevation of another embodiment of the lock of the invention used in pairs with an interconnecting cable for concurrent release of the locks.

FIGS. 13 and 14 illustrate additional embodiments of my invention wherein the lock embodiment illustrated in FIGS. 5–8 is employed in pairs operable by a release cable. FIG. 13 illustrates an embodiment in which each of bolts 124 within housings 100 is secured to a cable 176 passing through short sleeves 178 whereby shortening of cable 176 by rotation of pivotally mounted actuator 180 simultaneously retracts both bolts to release the door. Actuator 180 can be mounted on the underside of flange 20*a* and accessible through an opening, not shown, in wall 48*b* adjacent the space defined below ashtray 67 and reached by depressing plate 84. The embodiment of FIG. 14 is similar to that shown in FIG. 13 with the exception that an actuator is not used but the operator merely pulls on cable 182 to simultaneously retract the lock bolts.

It will be understood of course that modifications can be made in the embodiment of the invention illustrated and described herein without departing from the scope and purview of the invention as defined by the appended claims.

What I claim as new and desire to protect by Letters Patent of the United States is:

1. A modular wall cabinet and ashtray comprising, in combination, an exterior frame comprised of spaced sidewalls and top and bottom walls joined to form an integral rectangular structure, said frame walls having an outwardly extending peripheral flange for mounting the cabinet in a wall opening, a rectangular metal cabinet having a pair of opposed sidewalls and opposed top and bottom walls, said sidewalls having a pair of opposed recesses of equal width formed transversely therein equispaced from the bottom wall, an ashtray having a length substantially equal to the distance between the opposed recesses and having an equal thickness at each end slightly less than the width of the recesses for slidable insertion of the ashtray into said recesses whereby said ashtray is restricted from vertical movement and an ash receptacle space is formed within the cabinet below the ashtray, means for rigidly securing said cabinet to the exterior frame, a door pivotally mounted on said frame to open and close said cabinet, said door adapted to close said pair of opposed sidewall recesses and said ash receptacle space whereby the ashtray is locked in the cabinet when the door is closed, said door having an opening formed therein to permit access to the ashtray, and means mounted on the frame for locking the door in its closed position.

2. A modular wall cabinet and ashtray as claimed in claim 1 in which each of said sidewalls is fabricated of a pair of wall components joined together at the recess, the lower wall component having an outer planar face with an upper flange extending inwardly defining a lower edge of the recess and the upper wall component having an inner planar face co-planar with the flange and having an outwardly bent flange defining an upper edge of the recess, said outwardly bent flange having a downwardly bent extremity adapted to abut and be secured to the lower component outer face.

3. A modular wall cabinet and ashtray as claimed in claim 2, in which said means for rigidly securing the cabinet to the exterior frame comprises a pair of brackets on each side of the cabinet extending between the frame sidewalls and cabinet sidewalls and secured thereto.

4. A modular wall cabinet and ashtray as claimed in claim 3, in which the door is rectangular in shape and substantially conterminous with the frame peripheral flange, said door having a rearwardly bent peripheral flange formed on each edge adapted to abut the frame upon closing of the door, at least one door side flange having an inwardly bent flange, and locking means mounted on an outwardly extending peripheral flange on an exterior frame sidewall, said locking means having a bolt for engaging a door side flange inwardly bent flange.

5. A modular wall cabinet and ashtray as claimed in claim 4, in which said locking means comprises an elongated housing of substantially rectangular cross-section with sidewalls, and a front wall and a rear wall, said housing secured to an exterior sidewall flange, an elongated U-shaped bolt having a web and depending sidewalls slidably mounted within said housing with the bolt web adjacent the sidewall flange for linear reciprocal movement therein, said bolt sidewalls having bevelled extensions projecting from the housing adapted to be engaged by the door flange when the door is closed, said bolt having an upstanding intermediate wall extending transversely between the bolt sidewalls, a spring compressed within the housing abutting the inside of the bolt transverse wall and a housing rear wall whereby the bolt extensions normally are biased to project from the housing through the housing front wall, and said door and housing front wall each having an aperture formed therein adapted to be aligned with each other when the door is closed whereby a pin can be inserted through said apertures to engage the bolt transverse sidewall for depression of the bolt and bevelled extensions and release of the door.

6. A modular wall cabinet and ashtray as claimed in claim 5, in which said housing has slots formed in the front and rear walls adjacent the sidewalls, and in the rear wall adjacent the exterior frame sidewall flange, permitting the bolt sidewall bevelled extensions to project through the housing front wall and the bolt sidewalls and the web to extend through the housing rear wall.

7. A modular wall cabinet and ashtray as claimed in claim 6, in which the bolt extensions are undercut to accept the thickness of the inwardly bent door flange.

8. A lock adapted to engage a catch formed on the periphery of a door hinged to close on a framed opening comprising an elongated housing of substantially rectangular cross-section with sidewalls each having a flanged base adapted to be secured to the frame, a front wall and a rear wall, an elongated U-shaped bolt having a web and depending sidewalls slidably mounted within said housing with the bolt web adjacent the frame for linear reciprocal movement therein, said bolt sidewalls having bevelled extensions projecting from the housing adapted to be engaged by the door catch when the door is closed, said bolt having an upstanding intermediate wall extending transversely between the bolt sidewalls, a spring compressed within the housing abutting the inside of the bolt transverse wall and a housing rear wall whereby the bolt extensions normally are biased to project through the housing front wall, said door and housing front wall each having an aperture formed therein adapted to be aligned with each other when the door is closed whereby a pin can be inserted through said apertures to engage the bolt transverse sidewall for depression of the bolt and bevelled extensions for release of the door catch.

9. A lock as claimed in claim 8, in which said housing has slots formed in the front and rear walls adjacent the sidewalls, and in the rear wall adjacent the frame, permitting the bolt sidewall bevelled extensions to project through the housing front wall and the bolt sidewalls and the web to extend through the housing rear wall.

10. A lock as claimed in claim 9, in which the bolt extensions are undercut to accept the thickness of the inwardly bent door flange.

11. A lock adapted to engage a catch formed on the periphery of a door hinged to close on a framed opening comprising an elongated housing of substantially rectangular cross-section with sidewalls each having a flanged base adapted to be secured to the frame, a front wall and a rear wall, an elongated U-shaped bolt having a web and depending sidewalls slidably mounted within said housing with the bolt web adjacent the frame for linear reciprocal movement therein, said bolt sidewalls having bevelled extensions projecting from the housing adapted to be engaged by the door catch when the door is closed, said bolt having an upstanding intermediate wall extending transversely between the bolt sidewalls, a spring compressed within the housing abutting the inside of the bolt transverse wall and a housing rear wall whereby the bolt extensions normally are biased to project from the housing through the housing front wall, and a cable secured to the bolt and extending from the rear of the housing for retracting the bolt bevelled extensions.

12. A lock as claimed in claim 11, in which said housing has slots formed in the front and rear walls adjacent the sidewalls, and in the rear wall adjacent the frame, permitting the bolt sidewall bevelled extensions to project through the housing front wall and the bolt sidewalls and the web to extend through the housing rear wall.

13. A pair of locks as claimed in claim 11 or 12, in which the lock bolts are interconnected by a common cable.

14. A pair of locks as claimed in claim 11 or 12, in which the lock bolts are interconnected by a common cable and a pivotal actuator secured to said cable for retraction of the cable and lock bolts upon pivotal movement of said actuator and effective shortening of the cable.

15. A lock comprising an elongated housing having sidewalls with flanged bases and front and rear walls, said housing having slots formed in the front wall adjacent the sidewalls, a U-shaped bolt having a web and bevelled arms depending from said web, said bevelled arms adapted to project through the housing front wall slots, a compression spring mounted within said housing to abut the rear side of the bolt and the inner side of the rear wall whereby the bolt is normally biased against the inner side of the housing front wall with the bevelled arms projecting therefrom but can rock within the housing to releasably engage or release a door catch.

16. A lock as claimed in claim 15, which additionally comprises an elongated U-shaped member having a front wall and a rear wall interconnected by a web, the front wall of the U-shaped member disposed between the bolt web and the housing front wall, the rear wall of the U-shaped member abutting the exterior of the housing rear wall, and the web of the said U-shaped member extending adjacent the sidewall bases.

* * * * *